US006064687A

United States Patent [19]

Purcell

[11] Patent Number: 6,064,687

[45] Date of Patent: May 16, 2000

[54] MOBILE FURNACE FACILITY

[75] Inventor: Joseph Purcell, South Wales, N.Y.

[73] Assignee: Emerging Technologies International, LLC, South Wales, N.Y.

[21] Appl. No.: 09/207,176

[22] Filed: Dec. 8, 1998

Related U.S. Application Data

[60] Provisional application No. 60/069,366, Dec. 12, 1997.

[51] Int. Cl.[7] ..... F27D 23/00

[52] U.S. Cl. ..... 373/78; 373/102

[58] Field of Search ..... 373/2, 42, 43, 373/44–47, 60, 71–84, 102, 108

[56] References Cited

U.S. PATENT DOCUMENTS

| | | | |
|---|---|---|---|
| 4,283,678 | 8/1981 | Halter | 324/140 R |
| 4,466,104 | 8/1984 | Walzel | 373/78 |
| 4,468,781 | 8/1984 | Buhler | 373/84 |
| 4,543,124 | 9/1985 | Vallomy | 373/60 |
| 4,617,673 | 10/1986 | Fuchs et al. | 373/80 |
| 4,836,732 | 6/1989 | Vallomy | 373/79 |
| 5,153,894 | 10/1992 | Ehle et al. | 373/80 |

FOREIGN PATENT DOCUMENTS

| | | |
|---|---|---|
| 3421485A1 | 12/1985 | Germany . |
| 10038242 | 2/1998 | Japan . |
| 2022851 | 12/1979 | United Kingdom . |

*Primary Examiner*—Tu Ba Hoang
*Attorney, Agent, or Firm*—Hodgson, Russ, Andrews Woods & Goodyear LLP

[57] ABSTRACT

The present invention is a multi-faceted mobile furnace apparatus. The apparatus has a furnace system, an electrical system, a positioning system and a control unit. The furnace system has a set of movable electrodes, and at least two pour configurations, to transform a solid material into a molten state. The electrical system provides the electrode with a predetermined, yet changeable type of regulation, current, voltage, impedance, power, and/or imbalance of current. While the electrode positioning system moves the electrode, this movement determines if the electrode is properly positioned for the furnace to be an open arc system, a submerged resistance system, or submerged arc system. The above systems are monitored by the control unit. There by the furnace system, the electrical system and the positioning system can all be altered to achieve the most efficient and cost saving method to transform the solid material into the molten state.

12 Claims, 7 Drawing Sheets

MOBILE FURNACE FACILITY

This application is a non-provisional application of U.S. application Ser. No. 60/069,366, filed Dec. 12, 1997.

FIELD OF THE INVENTION

The present invention relates to a furnace system to melt an array of solid materials such as refractory and some metals.

BACKGROUND OF THE INVENTION

The prior art is replete with various types of furnaces to melt metals or refractory. These furnaces, generally, are those small and medium size units used in general foundry practice, heat treating and associated processes. Larger units are generally used for melting large quantities of metal or refractory as part of specific production processes such as the production of high purity alloy steels, processing batches of processes parts receiving vitreous enamel, annealing glass, and so on.

As such, each furnace is, normally, designed for a specific industry and, thus, purposes. For example, there are various types of furnaces, two of which are arc furnaces and submerged resistance. In arc furnaces heat is developed by an arc, or arcs, drawn either to a charge or above the charge. Direct arc furnaces are those in which the arcs are drawn to the charge itself. In indirect arc furnaces the arc is drawn between the electrodes and above the charge. A standard power frequency is used in either case, direct current (DC) electric power is an alternative source of energy.

In resistance furnaces of the submerged arc type, heat is developed by the passage of current from electrode to electrode through the charge. The manufacture of basic products, such as container glass, mineral wools, ceramic fiber and fiber glass, is the general service of a submerged resistance furnace. Alternating current (AC) at a standard power frequency is used.

Moreover depending on the purpose, the furnace may be a bottom pour, side pour or both ("pour configuration"); electrically configured for either low voltage, higher current in Delta, or higher voltage, lower current in the Wye ("electrical configuration"); and power regulation in either AC or DC.

None of the prior art patents describe a furnace able to change its pour configuration, electrical configuration, melting options and power regulation (collectively referred to as "Configurations") to determine the ultimate furnace for a particular material or process.

SUMMARY OF THE INVENTION

The present invention is a multi-faceted furnace apparatus. The apparatus has a furnace system, an electrical system, a positioning system and control unit. The furnace system has a set of movable electrodes, and at least two pour configurations, to transform a solid material into a molten state. The electrical system provides the electrode with a predetermined, yet changeable type of regulation, current, voltage, impedance, power, and/or imbalance of current. While the electrode positioning system moves the electrode, this movement determines if the electrode is properly positioned for the furnace to be an open arc system, a submerged resistance system or submerged arc system. The above systems are monitored by the control unit. There by the furnace system, the electrical system and the positioning system can all be altered to achieve the most efficient and cost saving method to transform the solid material into the molten state.

Detailed Description of the Present Invention

Figure 1:
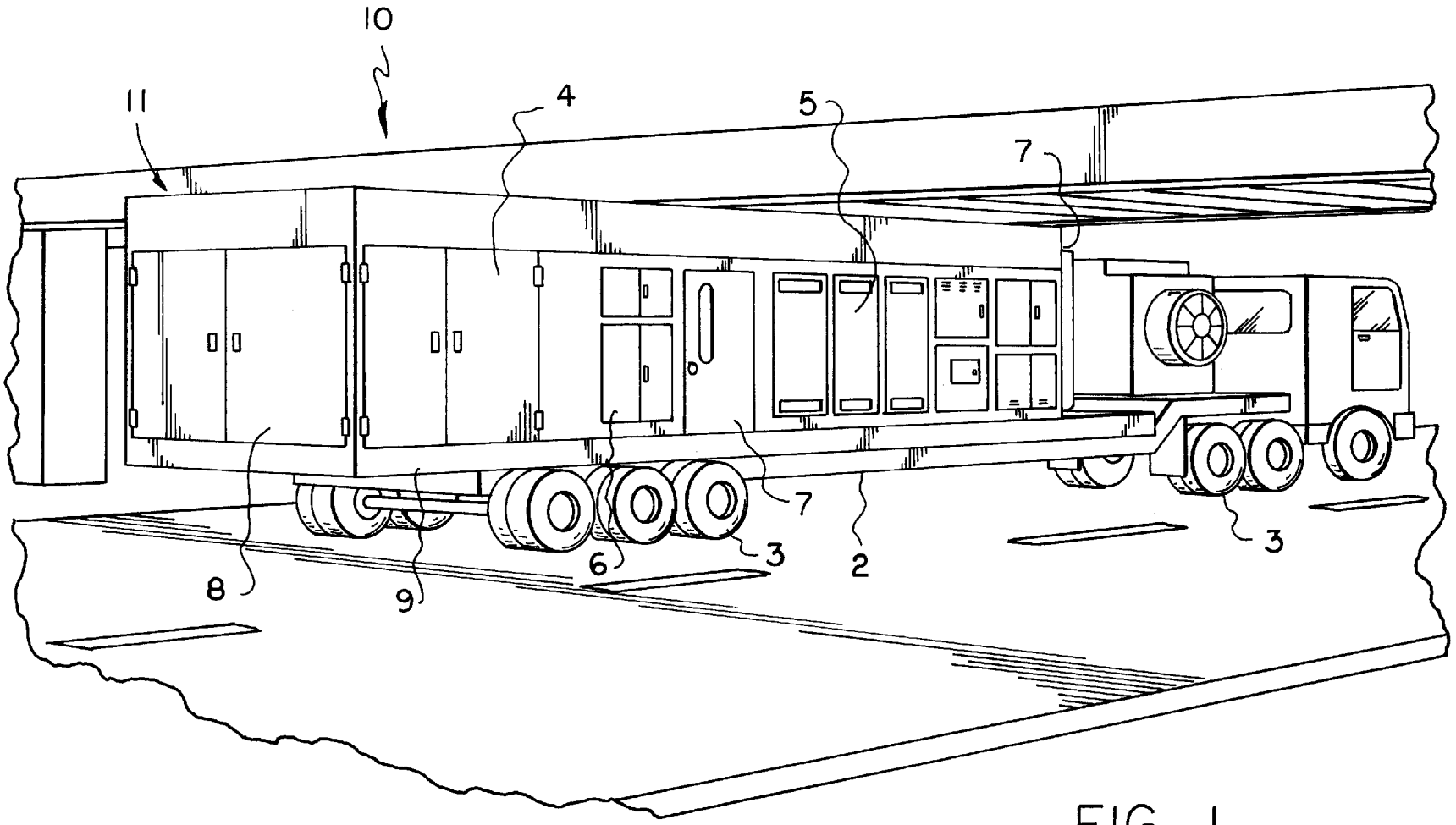
FIG. 1 is a side view of the present invention.

FIG. 1 shows a preferred embodiment of a furnace apparatus 10. In the preferred embodiment, the furnace apparatus 10 is a mobile unit having a platform 9 and a housing 11. The housing 11 is subdivided with furnace access doors 8, operator doors 7, operator console doors 6, electrical system access panels 5, and other sections 4, including the roof. A raising apparatus 3 elevates the apparatus 10, in particular the platform 9, a minimum distance above the ground, such as by wheels, blocks, or the like. Preferably, the apparatus 10 is designed to be transported. As such, the dimensions of the apparatus 10 allow it to be mounted onto a tractor trailer bed 2 and be transportable on the interstate highway system, i.e., under overpasses and without requiring additional highway permits.

Figure 2:
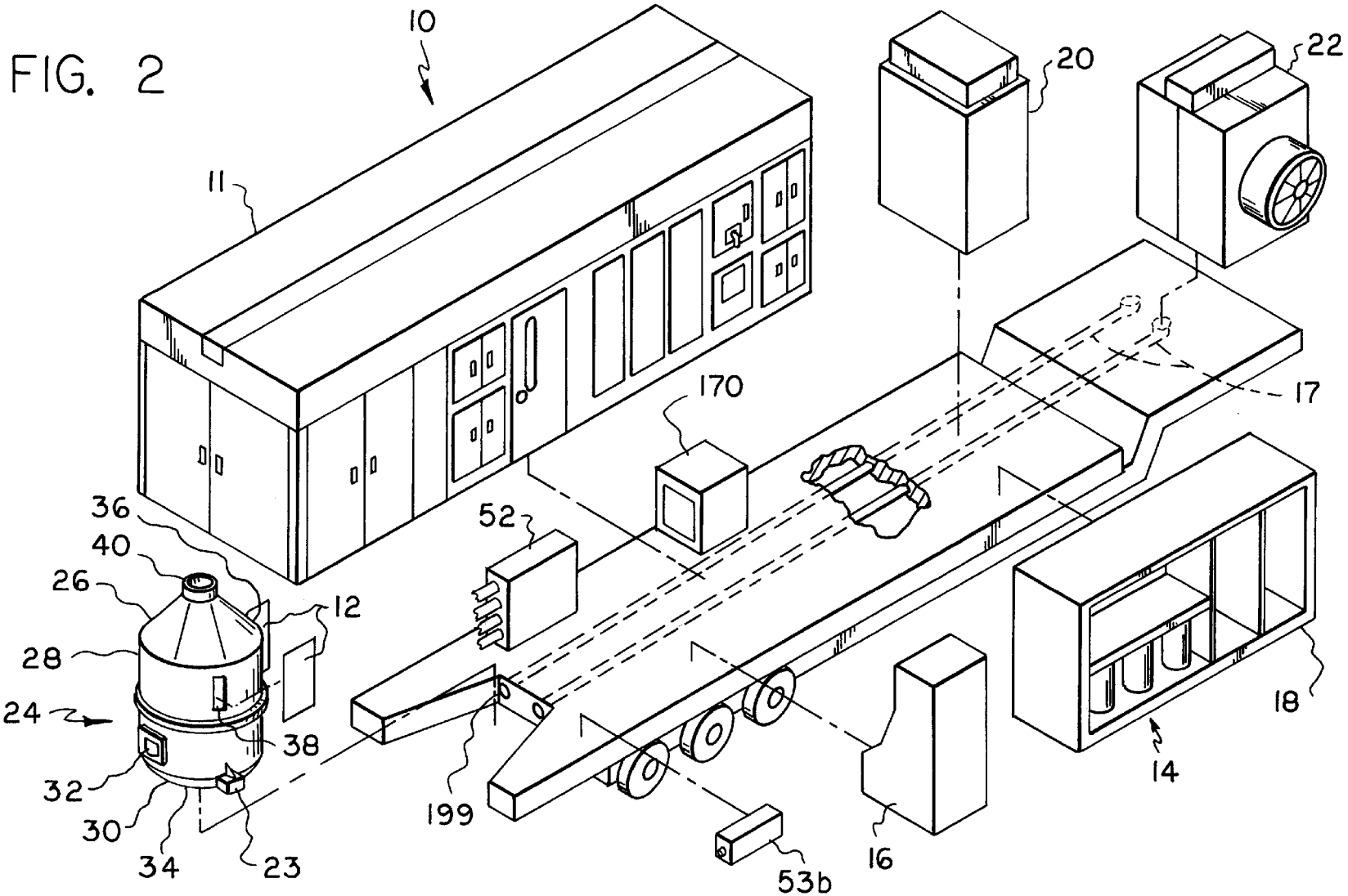
FIG. 2 is an exploded view of FIG. 1.

Turning to FIG. 2, the apparatus 10 has the housing 11, a melter/electrode positioner unit 12, a power regulation supply 14, a controller unit 16, a data acquisition system 170, a motor control system 18, a dust collecting system 20, a water cooling system 22, and a multi-faceted furnace 24. The controller unit 16 displays operational data from the other subsystems 12, 14, 18, 20, 22, 24. Each subsystems 12, 14, 18, 20, 22, 24 interconnects to the data acquisition system (hereafter "DAS") 170. The data system 170 collects and monitors this information and displays the results at the operator console unit 16. The user, not shown, through the console unit 16 and various manual override switches operates each subsystem 12, 14, 18, 20, 22, and 24, to change the apparatus' 10 Configurations. There are over 90 different configurations that can be set within a predetermined time frame. Depending on the Configuration change the time frame ranges between seconds to about four hours. By changing the Configurations, the user alters the function of the furnace 24 to obtain the ultimate furnace qualities for a particular material. Likewise and alternatively, the DAS 170 operates, by the user's discretion, the apparatus 10 by comparing previous inputs from each subsystem 12, 14, 18, 20, 22 and 24 to the present readings, and alters each subsystem to obtain the maximum and desired Configuration.

The foundation for apparatus 10 is the furnace 24. The furnace 24 receives a material, commonly called a charge, i.e., a metal, a refractory or an alloy. The furnace 24 melts it (to be described later), and then pours the molten material. The furnace 24, as shown in FIG. 2, has a conical top portion 26, a cylindrical middle portion 28 and a rounded bottom portion 30. Each portion 26, 28, 30 is insulated with conventional furnace insulation material, not shown, to retain its heat. On the exterior of the furnace 24, the furnace 24 has an operator door 36, various position apertures 38, an exhaust aperture 40, and two pour configurations 32, 34. In one embodiment, the conical top portion has a manifold 930 that reflects some of the heat generated in furnace 24 back to the furnace 24 and allows some of the heat to escape into the exhaust aperture 40.

Figure 3:
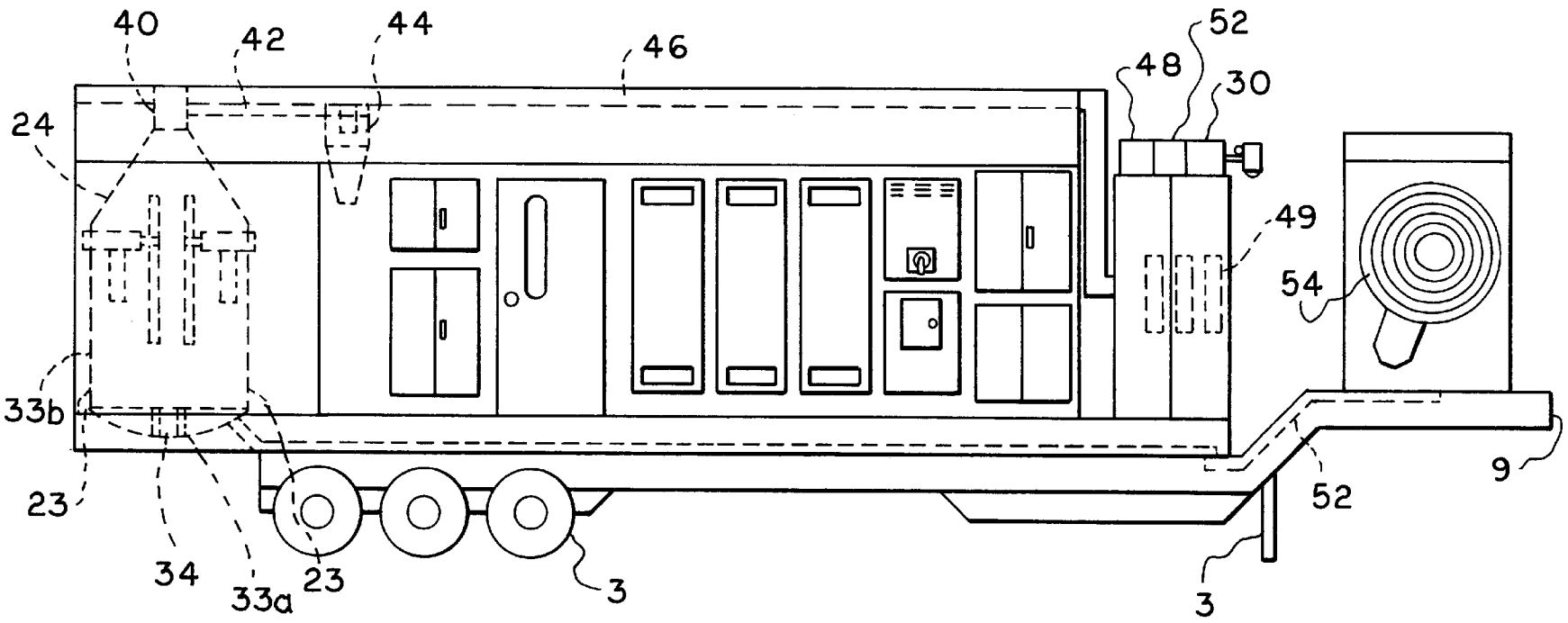
FIG. 3 is a side view of FIG. 1.

The first pour configuration allows the molten material to pour out a side spout 32 of the middle portion 28; the second pour configuration, turn to FIG. 3, allows the molten material to pour out the bottom orifice 34 at approximately 12" from the nadir of the rounded bottom portion 30.

Figure 4:
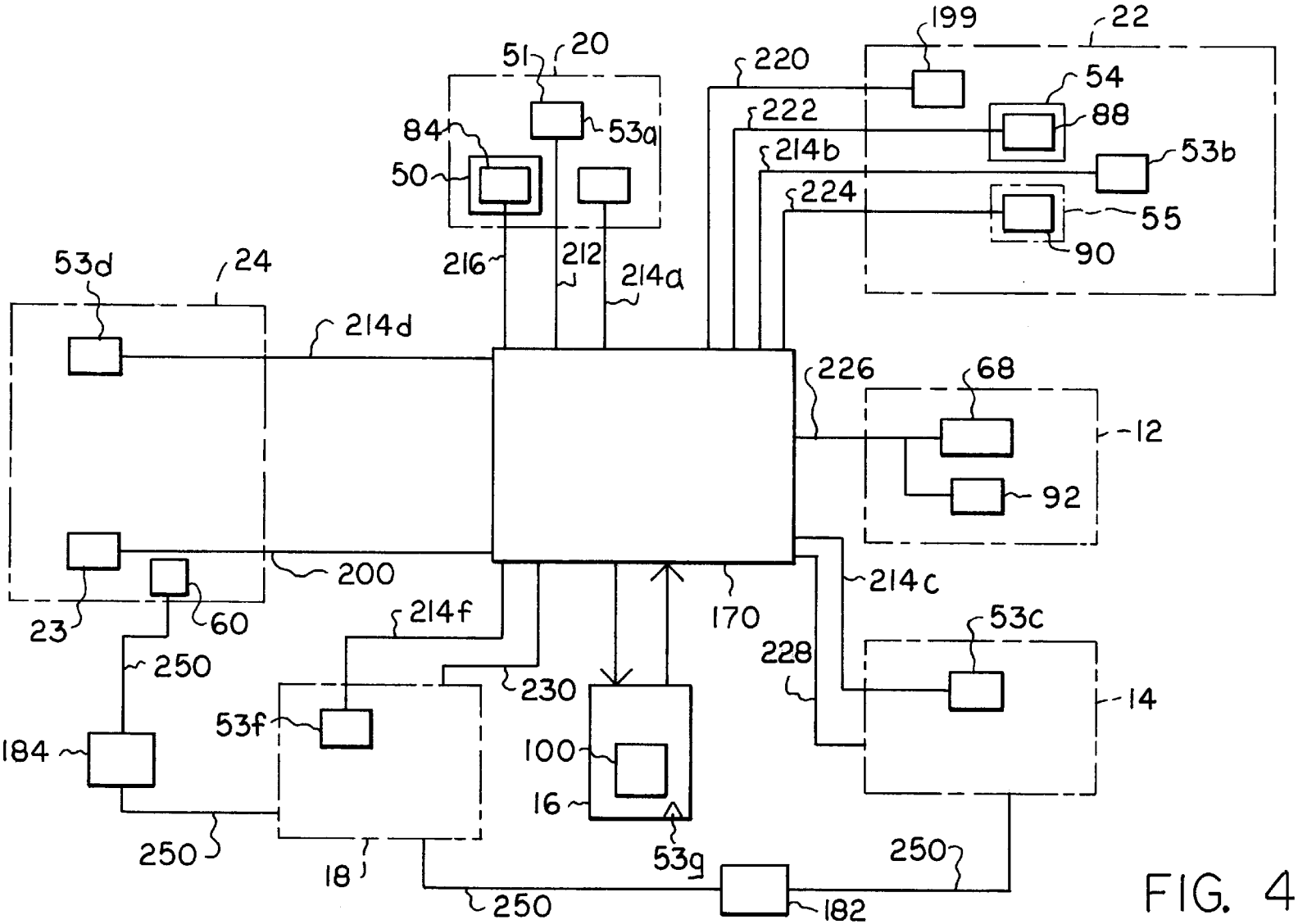
FIG. 4 is a schematic of the electrical system.

When the respective spout and orifice 32, 34, are open, the flow rate of the molten material is monitored by load cells 23. Each load cell 23, positioned about the furnace 24, generates a signal 200 proportional to the weight of the furnace and its charge. The DAS 170, as shown in FIG. 4, receives the signal 200, wherein the console unit 16 illustrates the results. As time passes, the difference in weight provides a method to calculate the flow rate of the molten material.

Figure 5:
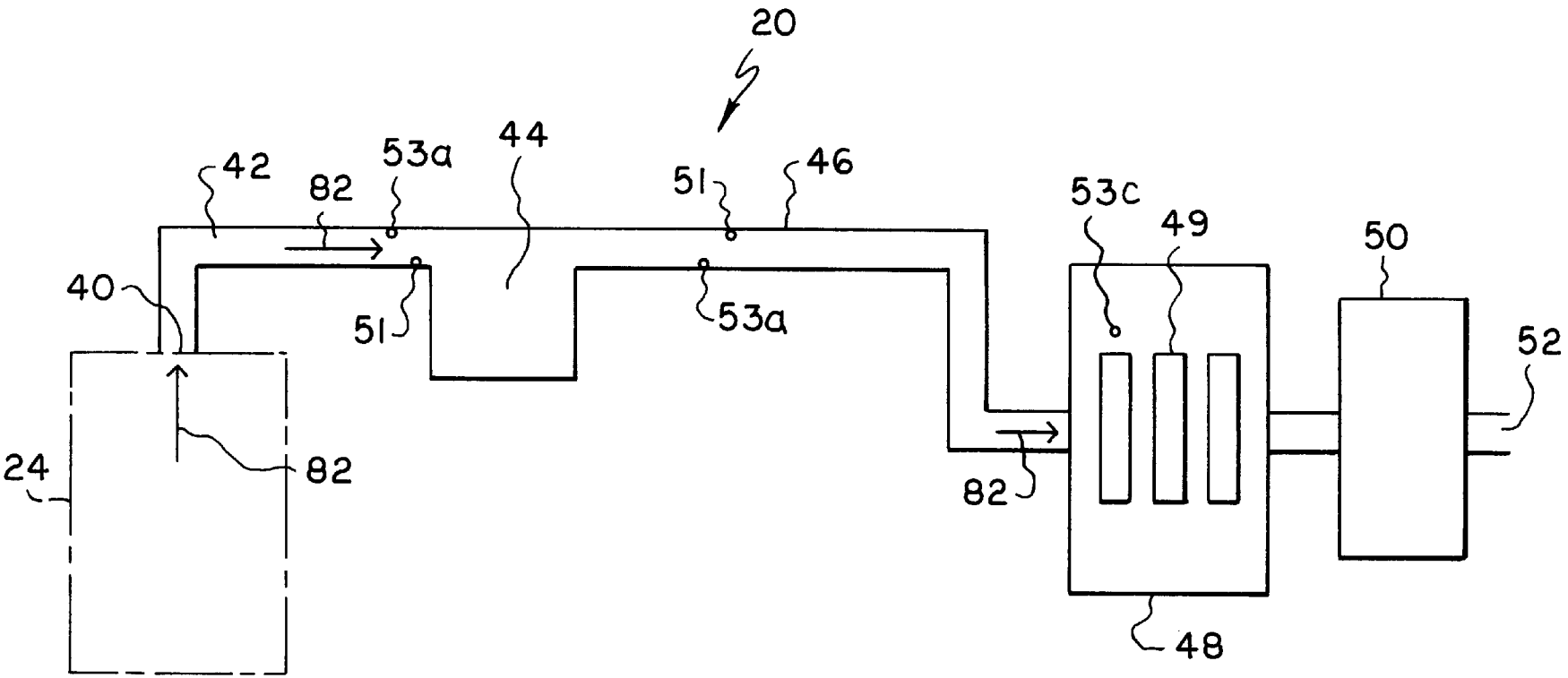
FIG. 5 is a schematic of the gas exhaust system.

Returning to FIG. 3, when the furnace 24 operates with any material, molten or solid, within it, the furnace 24 generates gases. As shown in FIG. 5, those gases 82 exit to the dust collecting system 20. While in the system 20, the temperature and velocity of the gases 82 are measured by a plurality of thermocouples 53*a* and air velocity instruments 51 respectively interspaced throughout the collecting system 20. The dust collecting system 20 draws the gases 82 into the aperture 40, at or about the apex of the top conical portion 26, into exhaust ducts 42 that leads to a cyclone 44. The cyclone 44 collects any particulate over a predetermined size. From the cyclone 44, the dust collecting system 20 further draws the gases through the exhaust ducts 46 into an exhaust/filter/dust bag house 48.

The bag house 48, preferably, has a high temperature filter 49 to collect pre-determined particulates, a compact fan 50, and an outlet 52. The system 48 is designed to insure that the gases emitted into the local environment, from the outlet 52, meet, and preferably exceed, any environmental output regulations under research and development restrictions.

The fan 50 is an industrial exhaust fan that draws the gases 82 from the furnace 24 through the outlet 52 into the environment. In the preferred embodiment, the fan 50 draws the gases from at least 25 feet. As such, the fan 50 must have sufficient capacity to draw these gases from the furnace 24. The amount of power depends on the air system leakage rate. This leakage rate is defined, in general terms, as the more the air system allows external air in, the harder it is to draw a vacuum on the furnace gases.

As shown in FIG. 4, the fan 50, thermocouples 53*a*, and air velocity instruments 51 interconnect with the console 16 and the DAS 170. The instruments 51, 53*a* transmit their respective measurements 212, 214*a* to the DAS 170 and, in return, to the console 16. The console 16 shows the measurements on a touch screen display unit 100. The flow rate of the fan can be altered, allowing more or less cooling to occur and thus effect the gas temperature.

To further control the temperature of the gases 82 in the system 20, the present invention uses the water cooling system 22 to cool the gases 82 and other subsystems.

Figure 6:
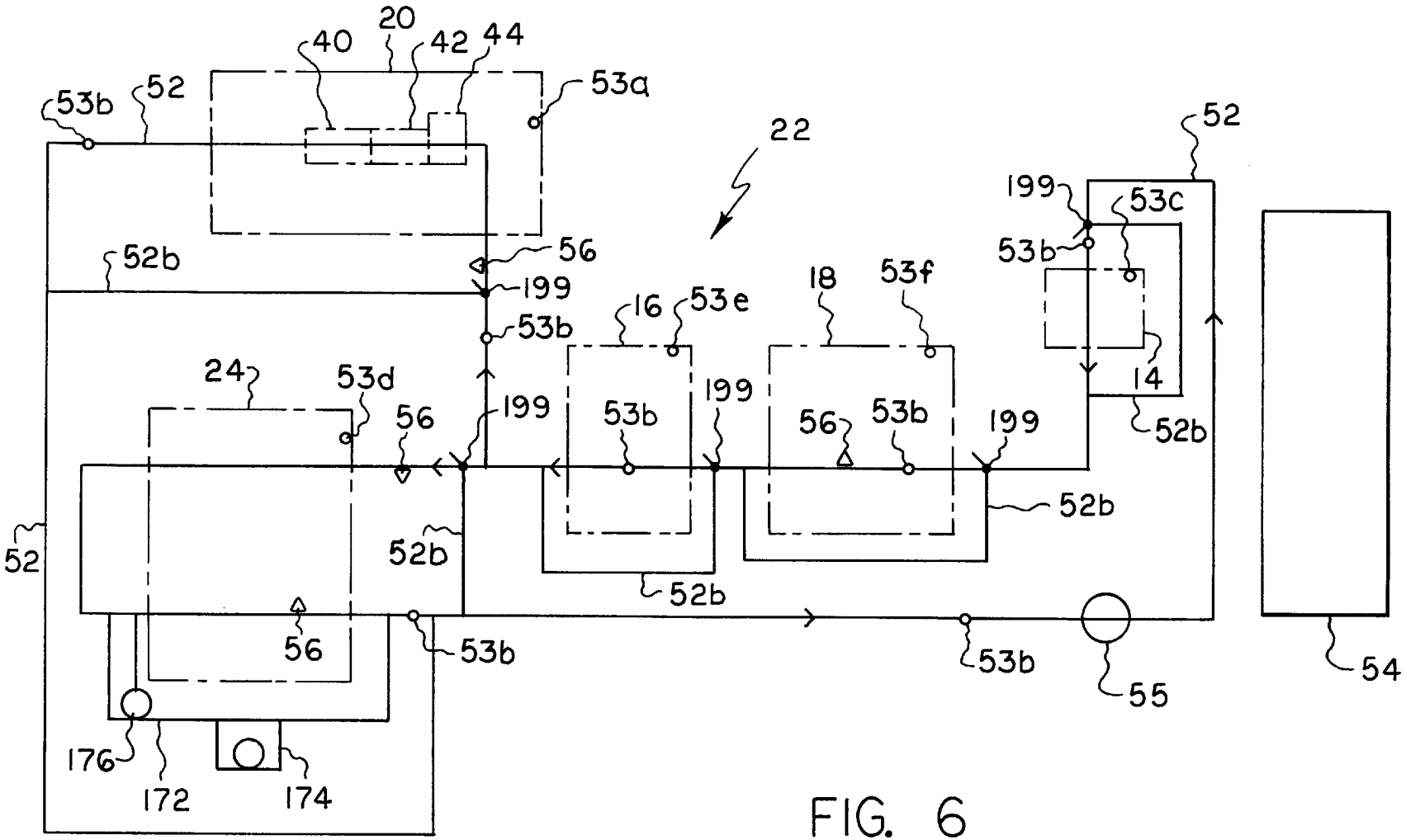
FIG. 6 is a schematic of the water system.

Turning to FIG. 6, the water cooling system 22 is an open system that circulates water, or any other coolant liquid, through water pipes 52. The water pipes 52 direct the liquid, by a centrifugal pump 55, through a cooling tower 54 that cools the liquid in the pipes 52 to a "cooled state". While in the cooled state, the liquid traverses, and thereby cools, the dust collecting system 20; in particular around the aperture 40, the exhaust pipe 42 and the cyclone 44; and the furnace 24. The operator can alter the liquid path through various interspaced flow meters 199, that are in a manifold arrangement. After cooling the various subsystems, 14, 20, 24, the liquid is in a "warm state." The warm liquid returns through the pipes 52 through the cooling tower 54 so it can return to its "cool state."

The cooling system 22 also has nozzles 56 attached thereto and each nozzle 56 directs the cooled liquid to the exterior shell of the furnace 24. The nozzles 56 ensure the furnace 24 does not overheat while operating; the liquid collects in a basin 172. A tank 174 collects the liquid from the basin 172.

The basin 172 has a pump up/pump down system 176. The system 176 pumps the hot liquid to pump 55 depending on the water level in the basin 172. If the water is high, the system 176 pumps water. In contrast, if the water in basin 172 is low, the system 176 does not pump.

Alternatively, the cooling system 22 can be a closed system, if a water jacket surrounds the furnace shell.

Also within the pipes 52 are interspaced thermocouples 53*b*. These thermocouples 53*b* measure the temperature of the liquid, supply and return liquid.

Returning to FIG. 4, the flow rate and temperature of the liquid is controlled by the operator through the console 16. The DAS 170 acquires data from the pump 55 and tower 54. The pump 55 operates the flow rate 90 of the liquid while the tower 54 outputs a fan rate 88. The flow rate 90 and fan rate 88, in combination with other parameters, such as variable speed pumps or chiller systems, control the temperature of the liquid in system 22. If the flow rate 90 is too fast, the fan 54, at any fan rate 88, will be unable to cool the liquid. Likewise, if the fan rate 88 is too slow, the liquid will never cool. Controlling the fan rate 88 and the flow rate 90 is critical to cool the liquid. As such, the operator, at the control unit 16 or at manual switches, transmits signals 222 and 224, respectively, to alter the fan rate 88 and the flow rate 90.

Each thermocouple 53*b* transmits its measurements 214*b* to the console unit 16 through the DAS 170. The console 16, in return, shows the measurements on the display unit 100. There are provisions for the operator to alter the fan rate 88 and the flow rate 90 depending on the liquid temperature in the system 22.

Alternatively, each flow monitor 199 interconnects to the DAS 170. As such, each monitor 199 transmits a signal 220 identifying the liquid path, the pipes 52 to the alternative pipes 52*b*. The alternative pipes 52*b* divert the liquid from any subsystem 14, 18, 20, 24 if the operator determines the subsystem requires a temperature change.

Turning to FIGS. 4 and 6, each subsystem 14, 20, 24 has at least one thermocouple 53*c*, 53*d*, 53*e*, 53*f*, 53*g* that measures the temperature of the subsystem. Each thermocouple 53*c–g* performs and transmits, by respective signals 214*c–g*, the relevant information to the DAS 170 and, in one embodiment, the information is displayed at the console 16 like thermocouples 53*a* and 53*b*.

The liquid in the cooling system 22 becomes a warmed state due to the heat generated within the subsystems 14, 20, and particularly the furnace 24. The furnace heat is generated in one of two ways: open arc or submerged resistance heating. In either case, the operator, at the console unit 16, controls the electrical motor system 18, the melter/electrode positioner unit 12, and the power regulator supply 14. These three systems determine how much heat will be generated in the furnace 24.

Figure 7:
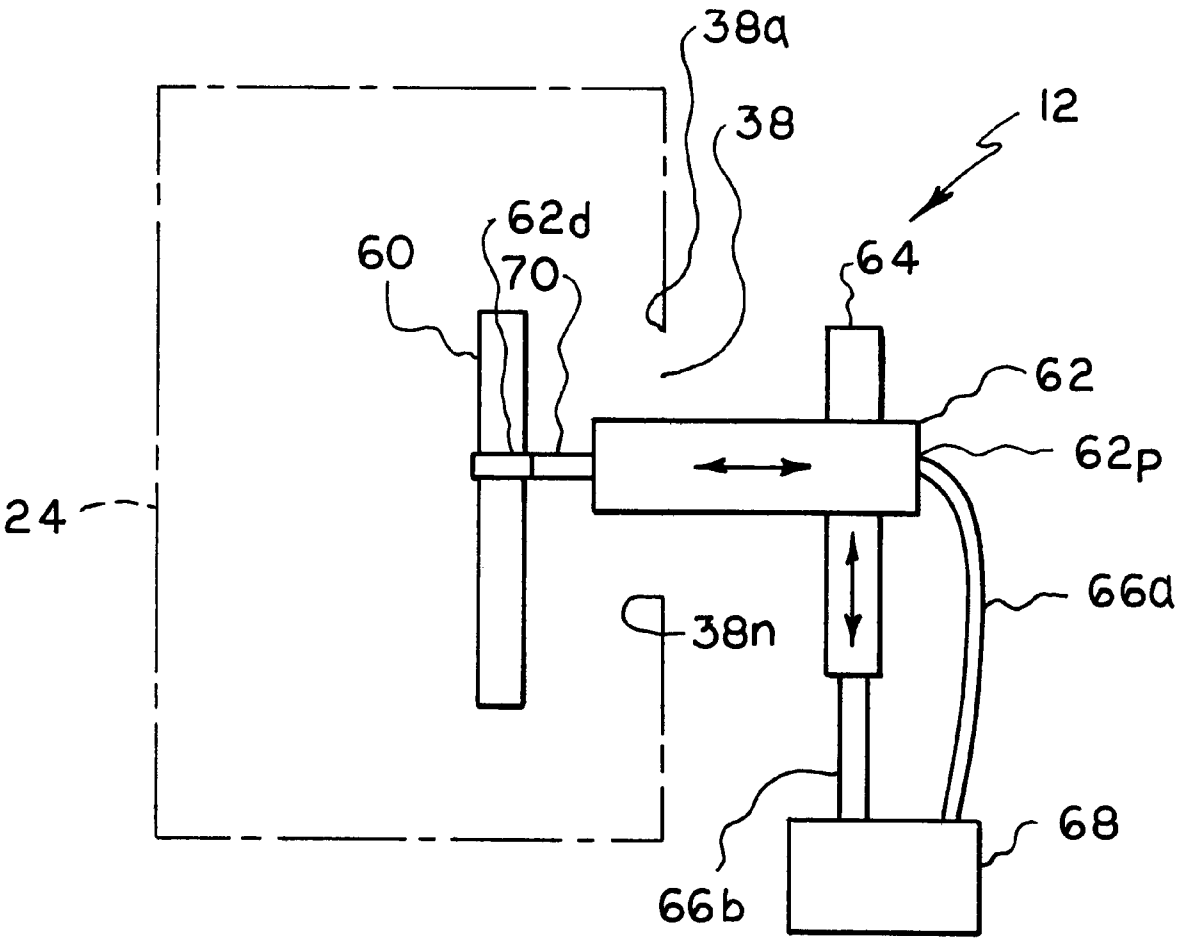
FIG. 7 is a schematic of the positioning system.

Turning to FIG. 7, each melter/electrode positioner unit 12 has an electrode 60, a lateral actuator 62, a vertical actuator 64, interconnections 66*a* and 66*b* for each actuator 62, 64, a power source 68, and an electrode holder 70. The electrode 60 is within the furnace 24, and connects to the distal end of the lateral actuator 62*d* with the electrode holder 70. The proximal end of the lateral actuator 62*p* connects to the vertical actuator 64, located on the exterior of the furnace 24, by electrode holder 70. As such, the lateral actuator 62 enters the furnace through the aperture 38. The lateral actuator 62 moves the electrode 60 in a lateral direction.

In contrast, the vertical actuator 64 moves the electrode 60 in a vertical direction. The lowest position the electrode can attain in the furnace 24 is the nadir of the aperture 38*n*. In contrast, the highest position the electrode can attain in the furnace 24 is the apex of the aperture 38*a*. As such, each electrode 60 can be moved in any lateral or vertical position, relative to the aperture 38 and depending on the method selected, open arc, submerged resistance, or submerged arc. The positioning of the electrode is controlled by the operator remotely at the console unit 16 or locally at the furnace 24 and automatically controlled during arc furnace operation to optimize the arc required. The electrode positioner unit 12 moves by any conventional power source. The power source can be hydraulic, electric or air.

Returning to FIG. 4, each power source 68 interconnects to the DAS 170 and the console unit 16. The power source 68 transmits a position signal 226 identifying the position of each vertical and lateral actuator 62, 64, and thereby the position of each electrode 60. The console unit 16 converts that signal into a display identifying the position of each electrode 60 in the furnace 24. The operator reviews the position of each electrode 60 and transmits the signal 226 to each power source 68 to move a particular electrode 60 to a desired position. Alternatively, the position of each electrode 60 can be manually controlled by a local operator switch unit 92. Switch unit 92 allows the operator to bypass the console unit 16 and move the electrodes 60.

Controlling the position of each electrode 60, in itself, does not control the amount of heat generated in the furnace 24. Each electrode 60 is controlled in three ways; at the furnace 24, at the console 16, and automatic control during arc furnace operation. Rather, the position of the electrode 60 along with the amount and type of power transmitted to the electrodes 60 determines the amount of heat. The amount of power is determined by the power regulating system 14.

Each system 14, 18 interconnects to the data system 170, the console unit 16, and each electrode 60. The system 14 provides the electrode 60 with either AC or DC current through line 250. The current can be generated within the housing 11 or, alternatively, received from an outside source (not shown). The system 14 transmits an AC or DC signal 228 to the DAS 170 identifying which mode of regulation the electrode 60 is receiving. The operator, at the console unit 16, terminates the current to the electrode or alters the mode of regulation being received by the electrode 60 by transmitting a return signal 228 to the system 14. Alternatively, there is a manual switch 182 that allows the operator to manually alter the current received by the electrode and/or terminate the electrode from receiving any type of current, and add reactance to the system during arc furnace operations.

The power regulator system 14 provides regulated power to the electrode 60 and operator console 16 provides the adjustment to establish the level of voltage, current, wattage, impedance, and imbalance current or imbalance of power to the electrode 60. The motor control system 18 consists of various electrical systems that control and monitor these various parameters, and transmits a control signal 230 for each parameter to the DAS 170 and the console unit 16. The operator, at the console unit 16, monitors each parameter and adjusts them accordingly from the console unit 16. Alternatively, the operator can manually adjust each parameter by a manual override switch 184, and even shut off, the parameters being sent to each electrode 60.

The display unit 100, alternatively, is a touch screen unit having a readout system and allowing the operator to view and alternatively control (and adjust) a single measurement or parameter, or a plurality of measurements and/or parameters simultaneously. Alternatively, the display unit 100 is a combination of the two embodiments to control (and adjust) and view the parameters and measurements of the apparatus 10.

The data acquisition system 170 is, but not limited to, a Pentium® based computer system with an array of analog to digital converters and pulse signal to digital converters. This array of signal processing units held within the computer adapts the various raw sensor signals for display locally at the DAS 170 and remotely at the display unit 100 which is mounted on the console 16.

Numerous variations will occur to those skilled in the art. It is intended therefore, that the foregoing descriptions are only illustrative of the present invention and that the present invention be limited only by the hereinafter appended claims.

We claim:

1. A mobile multi-faceted furnace apparatus comprising:

a furnace system having a set of movable electrodes and at least two pour configurations, to transform a solid material into a molten state;

an electrical system that provides each electrode with a preselected type and level of current, voltage, impedance, power, imbalance of current;

a positioning system that moves each electrode in the furnace system, the electrode position ranges from an open arc system to submerged resistance system; and a data acquisition system that monitors the furnace system, the electrical system and the positioning system, wherein each system alters its parameters to transform the solid material into the molten state;

wherein the apparatus is mobile.

2. The apparatus of claim 1 further comprising a cooling system that controls and monitors the temperature of a control unit, the electrical system and the furnace system, wherein the control unit allows an operator to control the electrical system, the furnace system and the positioning system.

3. The apparatus of claim 2 further comprising an exhaust system that removes the gases from the furnace system to the outside environment.

4. The apparatus of claim 3 further comprising a cooling system that controls and monitors the temperature of the electrical system and the furnace system and the exhaust system, wherein the control unit allows an operator to control the exhaust system, the electrical system, the furnace system and the positioning system.

5. The apparatus of claim 4 wherein the control unit controls the cooling system and the exhaust system.

6. The apparatus of claim 1 further comprising a control unit that allows an operator to control each system in conjunction with the data acquisition system.

7. A method of using a mobile multi-faceted furnace apparatus comprising the steps of:

providing a furnace system having a set of movable electrodes and at least two pour configurations, to transform a solid material into a molten state;

setting each electrode with a predetermined type and level of current, voltage, impedance, power, imbalance of current via a power regulation system;

positioning each electrode in the furnace system by a positioning system, the position of each electrode ranges from an open arc system to a submerged resistance system;

monitoring the furnace apparatus through a control unit which records the Positioning system, the power regulation system, and the furnace system to transform the solid material into the molten state and to alter the apparatus between its two pour configurations; and moving the multi-faceted furnace apparatus to a different location.

8. The method of claim 7 further comprising a cooling system that controls and monitors the temperature of the positioning system, the power regulation system, and the furnace system.

9. The method of claim 7 further comprising an exhaust system that removes the gases from the furnace system to the outside environment.

10. The method of claim 9 further comprising a cooling system that controls the temperature of the positioning system, the power regulation system, the furnace system and the exhaust system.

11. The method of claim 10 wherein the control unit controls the cooling system and the exhaust system.

12. The method of claim 7 wherein the control unit allows an operator to control each system in conjunction with a data acquisition system.

* * * * *